US005624166A

United States Patent [19]

Theken et al.

[11] Patent Number: 5,624,166

[45] Date of Patent: Apr. 29, 1997

[54] ANTI-TIP GUARD FOR MOBILE FILING CABINETS

[76] Inventors: Randall R. Theken, 1115 Robinson Ave., Barberton, Ohio 44203; Jack W. Jeter, 1008 Margate Dr., Akron, Ohio 44313

[21] Appl. No.: 456,494

[22] Filed: Jun. 1, 1995

[51] Int. Cl.[6] ..... A47F 5/00

[52] U.S. Cl. ..... 312/201; 312/199; 211/162; 211/94

[58] Field of Search ..... 312/201, 198, 312/199, 249.1, 249.8, 301; 211/162, 94

[56] References Cited

U.S. PATENT DOCUMENTS

| | | | |
|---|---|---|---|
| Re. 35,047 | 10/1995 | Potter | 312/201 X |
| 2,166,704 | 7/1939 | Foulkes . | |
| 3,198,592 | 8/1965 | Zippel | 312/198 |
| 3,923,354 | 12/1975 | Young . | |
| 4,597,615 | 7/1986 | Steger . | |
| 4,615,449 | 10/1986 | Naito et al. . | |
| 4,770,475 | 9/1988 | Peterman . | |
| 4,982,852 | 1/1991 | Johansen | 211/162 |
| 5,004,304 | 4/1991 | Segerpalm et al. . | |
| 5,007,351 | 4/1991 | Muth . | |
| 5,013,101 | 5/1991 | Muth . | |
| 5,062,536 | 11/1991 | Tsai | 211/162 |
| 5,069,513 | 12/1991 | Farrell et al. . | |
| 5,160,189 | 11/1992 | Johnston et al. . | |
| 5,226,549 | 7/1993 | Price, Jr. et al. | 312/198 X |
| 5,285,910 | 2/1994 | Chen | 211/162 |
| 5,341,944 | 8/1994 | Latino | 211/162 |

FOREIGN PATENT DOCUMENTS

| | | | |
|---|---|---|---|
| 2823217 | 5/1979 | Germany | 211/162 |
| 1057006 | 11/1983 | U.S.S.R. | 312/198 |

*Primary Examiner*—Peter M. Cuomo
*Assistant Examiner*—Janet M. Wilkens
*Attorney, Agent, or Firm*—Hudak & Shunk, L.P.A.

[57] ABSTRACT

Mobile storage cabinets which are "slide-by" cabinets, that is, the cabinets ride on a carriage in a longitudinal direction on a cabinet track to allow access to the contents of a posterior cabinet. The top surface of the posterior cabinet includes an anti-tip track which is substantially parallel to the cabinet track. The anti-tip track has a cylindrical groove with a longitudinally extending top opening which forms a slot. A football-shaped is captured in the groove to form a journaled follower which optionally includes roller bearing surfaces, vertical link extends through the slot and is joined at a fixed angle to a horizontal link which is pivotally joined to a bracket member attached to the back surface of a front cabinet. The bracket extends beyond the top of the cabinet. If multiple rows of cabinets are used, the anti-tip assemblies for the cabinets of each row are stepped so that they clear the top of posterior cabinets.

14 Claims, 4 Drawing Sheets

ANTI-TIP GUARD FOR MOBILE FILING CABINETS

FIELD OF INVENTION

The present invention relates to an anti-tip track system for use with mobile, high-density filing cabinets, and more particularly to an anti-tip follower which is hinged to compensate for irregularities in the floor upon which the cabinet rests.

BACKGROUND OF THE INVENTION

Mobile filing cabinets are used for high-density storage of files which need to be easily accessed, such as medical or legal files. These cabinets are mounted on carriages which are secured in floor-mounted tracks so that they can be moved to access the contents of that or of another file cabinet. This mobility reduces the floor space needed for aisle space between cabinets.

In order to maximize the storage space, the cabinets have several levels of files, which may be stacked or hang within the cabinet. Consequently, the cabinets can be heavy when they are loaded with papers, and can have a relatively high center of gravity. In order to decrease a risk of tipping, the files can be provided with a secondary track which stabilizes the top of the cabinet.

In accordance with the present invention, an anti-tipping track and follower is provided which can advantageously be used in instances where the floor is not level. This anti-tip system has a captured puck which is pivotally connected to the cabinet so that the puck rotates in the track to compensate for a floor which may be angled. Thus, the present invention eliminates the need to build a sub-floor or to shim the cabinet track in order to create a level carriage surface.

Accordingly, it is on object of the present invention to provide an improved anti-tip system for use with mobile, high-density filing cabinets, and in particular for use in areas having non-level floor surfaces.

The anti-tip system in accordance with the present invention comprises a track and follower which is connected to a cabinet, and which includes means to compensate for a vertical rise in the floor supporting the cabinet. One particularly preferred means to compensate for such a rise comprises a pivotally attached arm which will change its angle relative to the longitudinal axis of the anti-tip track to compensate for a change in the angle of the longitudinal axis of the carriage means, and a follower which will rotate radially about the longitudinal axis of the anti-tip track.

DETAILED DESCRIPTION OF THE INVENTION

Figure 1:
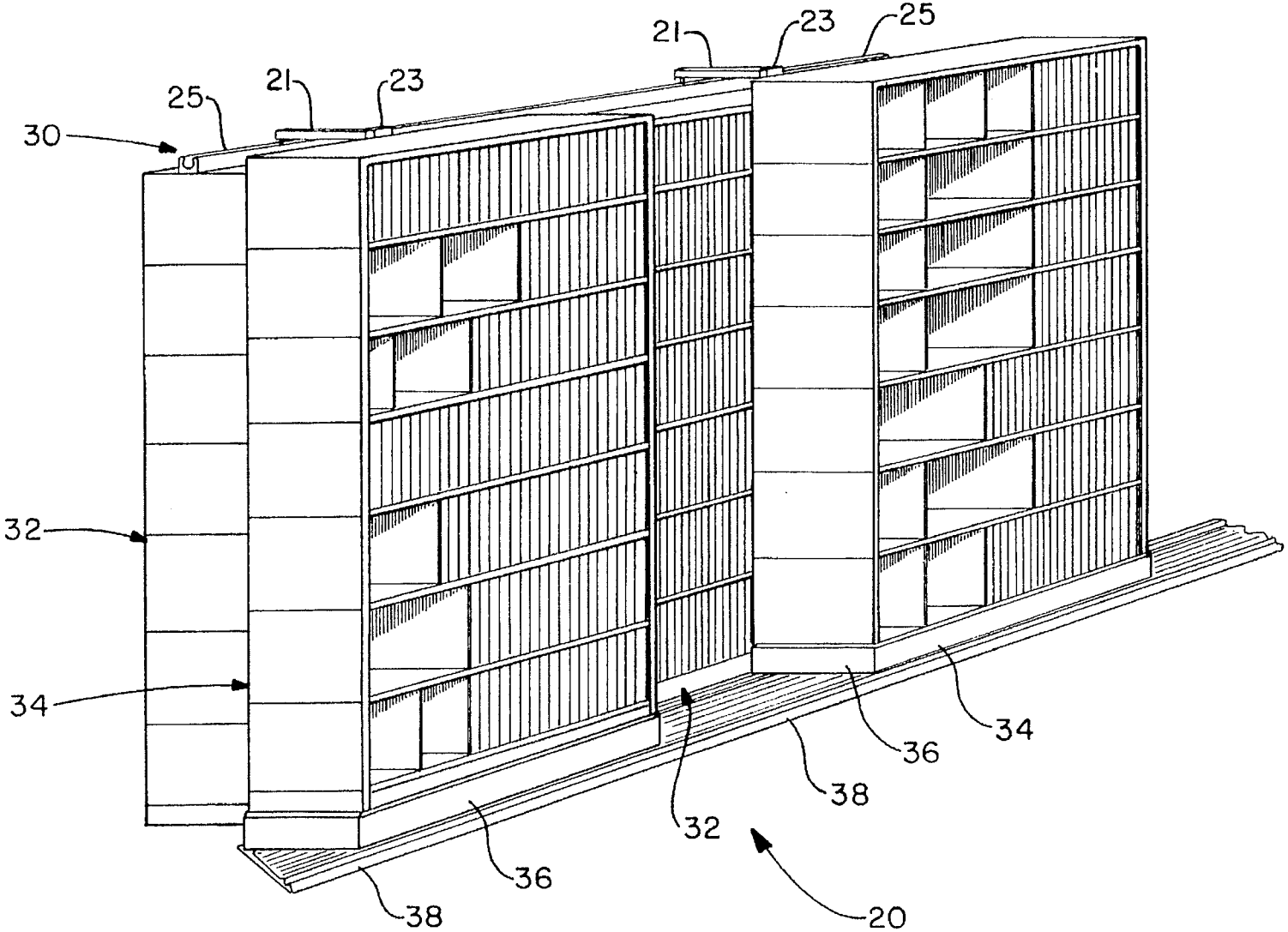
FIG. 1 is a perspective view of a mobile filing cabinet including an anti-tip track in accordance with the present invention.

The present invention relates to an anti-tip track and follower system for use with mobile storage cabinets as shown generally in FIG. 1. In particular, this figure illustrates a mobile filing system 20, which includes a first set of stationary cabinets 32 which rest directly on the floor. The system 20 also includes a second set of mobile cabinets 34, each of which is supported by a carriage 36 which rides on a track 38.

Figure 2:
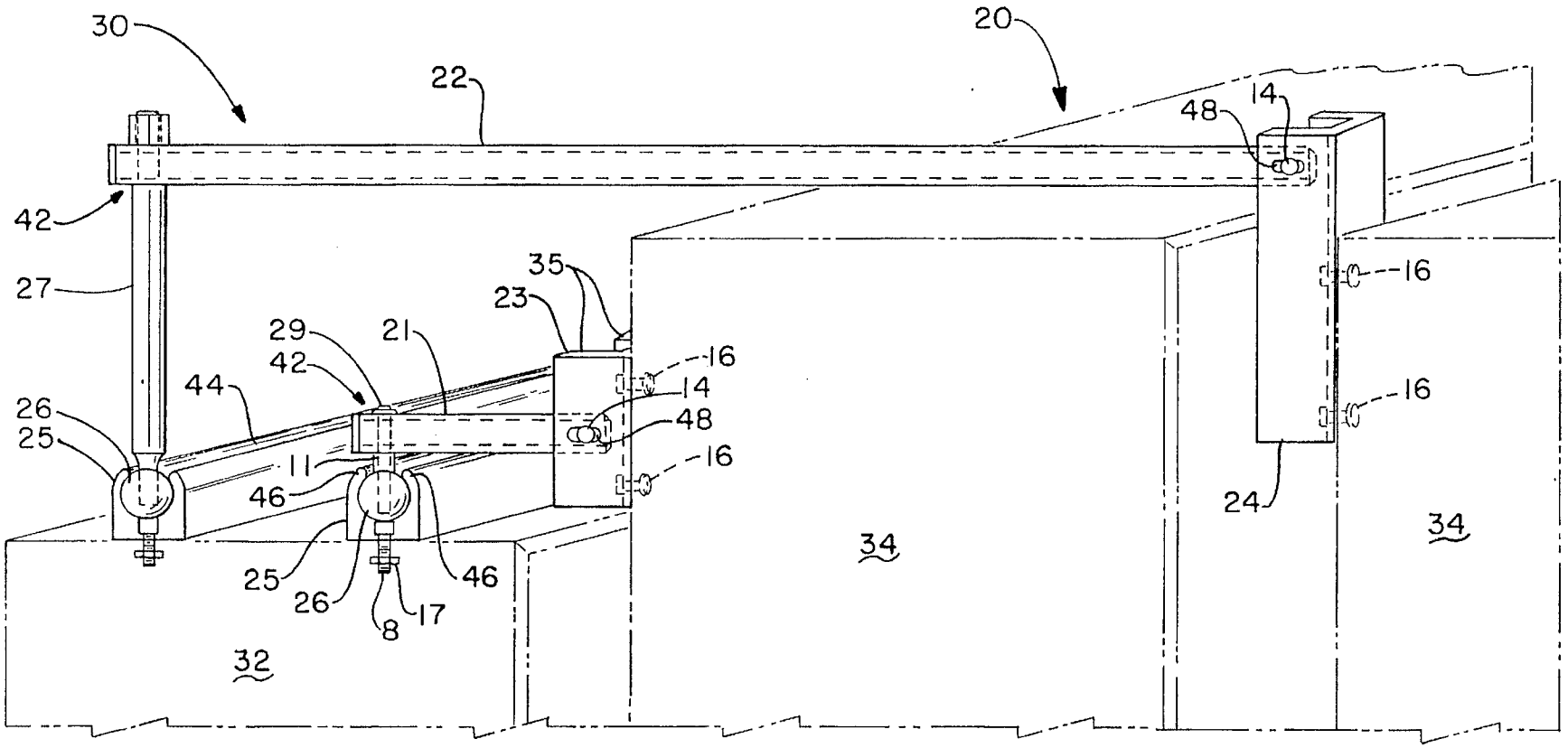
FIG. 2 is a detailed perspective view of the anti-tip track and follower system in accordance with the present invention.

The filing system includes an anti-tip track and follower system generally indicated as 30, in accordance with the present invention. The track and follower system 30 generally includes n anti-tip track 25 for each row of mobile cabinets 34. FIG. 2 illustrates the anti-tip system for use with two rows of mobile cabinets 34. As can be seen, these two rows are differentiated by the height of the horizontal arms 21,22 which link the follower 26 with the cabinet. The anti-tip tracks 25 are mounted parallel to the direction of travel on the top of the stationary cabinet 32.

Figure 3:
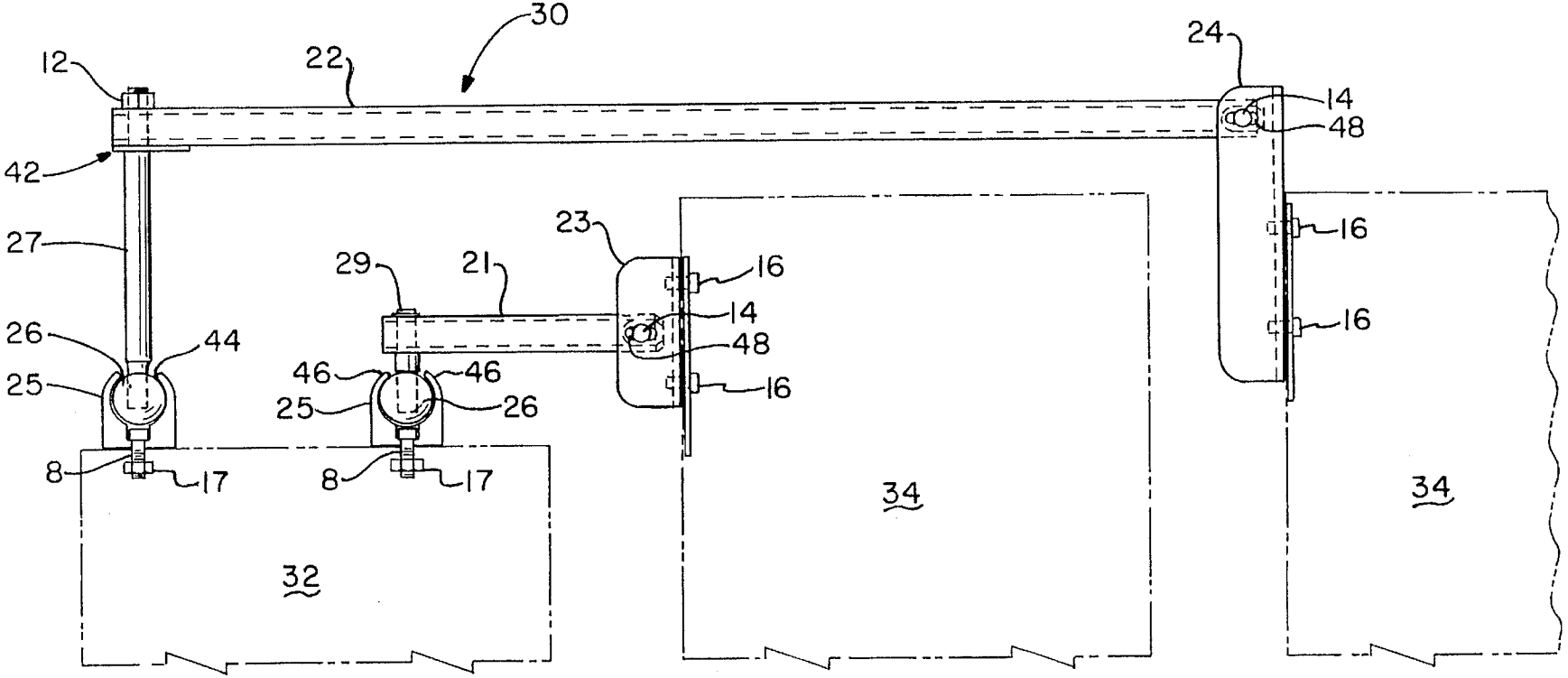
FIG. 3 is a side elevational view of the follower system in accordance with the present invention.

Each mobile filing cabinet 34 includes a follower 26 and follower linkage 42 which stabilizes the mobile cabinet and prevents it from tipping. The follower 26 (also shown in FIG. 3) is preferably a cylindrical, ellipsoid, or submarine-shaped puck which is captured in the track 25. The track 25 includes a corresponding cylindrical groove 44 having smooth, radially symmetrical bearing surfaces. The puck can be constructed of a low-friction material, such as Teflon® or, alternatively, can include longitudinal ball bearings. Alternatively, the track 25 can include the bearing surface and the follower 26, and can be in the form of a sleeve which captures the track, but which can rotate radially while continuing to operate as a bearing surface.

The follower linkage 42 compensates for changes in the angle of the longitudinal axis of the anti-tip track relative to a horizontal line. This serves to compensate for non-level floors. The linkage 42 has a bracket member 23 which is secured to the back side of the first row of filing cabinets by bolts, screws, or rivets 16.

The bracket member 23 has a U-shaped cross-section as shown in FIG. 2. The opposing side walls 35 each include elongated slots 48 which extend in the direction of the longitudinal axis of a horizontal arm 21 of the linkage 42. For example, the slots 48 may allow for from about 0.2 to about 1.0 inches of horizontal play.

The horizontal arm 21 is pivotally mounted at a first end to the bracket 23 by a pivot arm 14 which rides in slots 48 in order to compensate for a change in the distance between the cabinet compartment and the anti-tip track.

A bore in the second end of the horizontal arm 21 receives a vertical link 11 which is secured at a right angle to the horizontal arm 21 by screw 29. The vertical link 11 is connected to the follower 26 which is captured by the side flanges 46 of the track 25. The track 25 has a longitudinal opening which forms a radial angle of from about 45° to about 90° and preferably about 70° to about 80°. The track is held to the stationary cabinet such as by nut and bolt 17,8.

A similar linkage is used for the second row of mobile cabinets except that the base member 24 extends upwardly beyond the top of the first row of cabinets, the horizontal link 22 extends across the depth of the first row of mobile cabinets, and the vertical link is longer to compensate for the increase in height. Thus, the storage cabinets 32,34 are vertically stacked to allow the anti-tip systems to operate independently of each other.

As the mobile cabinets encounter a rise in elevation, the horizontal arms 21,22, pivot with respect to the brackets 23,24. Consequently, the followers rotate in the track 25, but continue to function as bearing surfaces and to prevent the cabinets from becoming unstable. The system will compensate for a floor rise of about 2 inches over a 6-foot span. The horizontal arms can travel about 1 inch to compensate for a slight deviation from a parallel configuration of the tracks.

Figure 4:
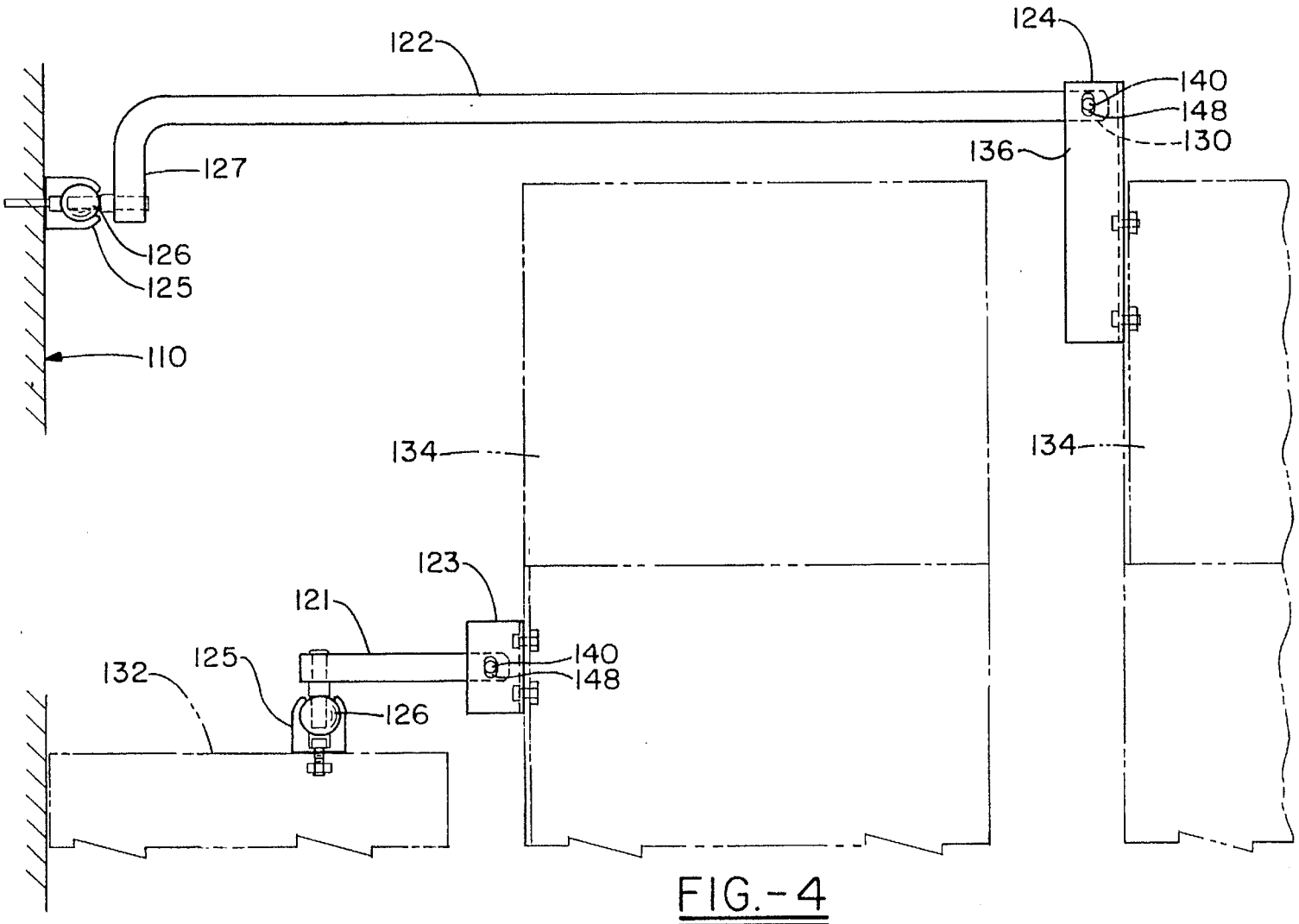
FIG. 4 illustrates an alternative system.

FIG. 4 illustrates an alternative embodiment of the invention in which the track 125 is mounted on a vertical surface 110 such as a wall. The follower 126 is linked to a bracket 124 which extends beyond the top of a forward, upright, storage compartment 134. The follower 126 is bolted to the downwardly extending arm 127 at a first end of link 122. The link 122 is pivotally attached at its second end to the bracket 124 such as by means of a free arm 140 extending perpendicular to the long axis of the link 122 and captured within slots 148 in either side of the side walls of the bracket 124. The bracket 124 corresponds in shape to the bracket shown in FIG. 1

A rearward storage cabinet has a track and follower system including a bracket 123 with a pivotable link 121 connected to a follower 126 that rides in an anti-tip track 125 an anti-tip track mounted on a horizontal surface such as the top 132 of a still more rearward storage cabinet or a shelf.

While in accordance with the patent statutes the best mode and preferred embodiment has been set forth, the scope of the invention is not limited thereto, but rather by the scope of the attached claims.

What is claimed is:

1. A storage cabinet comprising:

an upright storage compartment, a compartment carriage and floor-mounted track, and an anti-tip means, said storage compartment being supported by said compartment carriage and said compartment carriage being movable in a first longitudinal direction along said compartment track, said anti-tip means comprising an anti-tip track and a follower movable along said anti-tip track in a second longitudinal direction which is substantially parallel to the first longitudinal direction, said follower being operatively connected to said storage compartment by link means, said link means being pivotable with respect to said storage compartment and wherein said follower has longitudinal axis aligned with said second longitudinal direction and is rotatable about its longitudinal axis in response to the pivoting of said link means.

2. A storage cabinet as set forth in claim 1, wherein said link means is pivotable in response to travel of the compartment along the track.

3. A storage cabinet as set forth in claim 2, wherein the follower is captured in the anti-tip track.

4. A storage cabinet as set forth in claim 3, wherein the link means comprises a bracket secured to the storage compartment, a horizontal link and a vertical link, said vertical link being attached to the follower at a fixed angle and said horizontal link being attached t one end to the vertical link at a fixed angle and being pivotally attached to the bracket at the other end.

5. A storage cabinet as set forth in claim 4, wherein the anti-tip track includes a cylindrical shaped groove hating a slot and the follower has a substantially cylindrical shape and the vertical link extends through said slot.

6. A storage cabinet comprising an anti-tip assembly and a mobile storage compartment which is supported by a carriage that rides on a compartment track, said anti-tip assembly comprising:

a follower and an anti-tip track having a longitudinal axis and the anti-tip track includes a cylindrical groove which is open at the top to form a longitudinal slot and the follower is supported by said anti-tip track and has a circular cross-section and is captured in the grove so that the follower moves longitudinally with respect to the anti-tip track; and link means which operatively connects the compartment and the follower in order to inhibit the tipping of the compartment and which includes a vertical link which is attached to the follower and a horizontal link which is operatively connected at a first end to the vertical link and at a second end to the compartment and at least one of said first and second ends are capable of reciprocating motion in response to a rise in the compartment track.

7. A storage cabinet as set forth in claim 6, wherein the assembly further includes a bracket which is joined to the compartment and tile horizontal link is pivotally joined to the bracket at one end.

8. A storage cabinet as set forth in claim 7, wherein the horizontal link is joined at a fixed angle to the vertical link and the vertical link is joined at a fixed angle to the follower.

9. A storage cabinet as set forth in claim 8, wherein the vertical link extends through the longitudinal slot and the follower can rotate about its longitudinal axis in the groove in response to the pivoting of the horizontal link with respect to the bracket.

10. A storage cabinet comprising an anti-tip assembly and a mobile storage compartment which is supported by a carriage that rides on a compartment track, said anti-tip assembly comprising:

an anti-tip track having a longitudinal axis and a follower supported by said anti-tip track and which moves longitudinally with respect to the anti-tip track; and link means operatively connected to the compartment at a first end and to the follower at a second end and wherein tile assembly includes means to compensate in a rise in the compartment track whereby the first end of the link means pivots relative to the compartment and tile follower pivots relative to the anti-tip track.

11. An anti-tip assembly as set forth in claim 10, wherein said first end pivots simultaneously with said second end.

12. An anti-tip assembly as set forth in claim 11, wherein the link means includes means to adjust the distance between the compartment and the anti-tip track.

13. An anti-tip assembly as set forth in claim 12, wherein the compartment includes a bracket, and said link means is hinged in a slot in said bracket.

14. An anti-tip assembly as set forth in claim 13, wherein said link means is mounted on a pivot bar which can move in the direction of the longitudinal axis of the link means in the slot in the bracket.

* * * * *